US007291097B1

(12) United States Patent
Dace et al.

(10) Patent No.: US 7,291,097 B1
(45) Date of Patent: Nov. 6, 2007

(54) AMBULATORY PATIENT SUPPORT MECHANISM

(76) Inventors: Les N. Dace, 18418 N. Diamond Dr., Surprise, AZ (US) 85374; Pamela Dace, 18418 N. Diamond Dr., Surprise, AZ (US) 85374; Mark Christopher Dace, 582 Landing Party La., Collierville, TN (US) 38017

( * ) Notice: Subject to any disclaimer, the term of this patent is extended or adjusted under 35 U.S.C. 154(b) by 399 days.

(21) Appl. No.: 10/917,429

(22) Filed: Aug. 12, 2004

(51) Int. Cl.
*A63B 22/00* (2006.01)

(52) U.S. Cl. ..... 482/69; 482/51

(58) Field of Classification Search ..... 482/66–69, 482/51; 104/89, 62; 472/15
See application file for complete search history.

(56) References Cited

U.S. PATENT DOCUMENTS 3,985,082 A * 10/1976 Barac ..... 104/89
4,445,502 A 5/1984 Swan et al.
4,911,426 A 3/1990 Scales
4,948,118 A * 8/1990 Miraglia ..... 482/55
5,569,129 A 10/1996 Seif-Naraghi et al.
5,603,677 A 2/1997 Sollo
5,709,154 A * 1/1998 Schott ..... 105/29.1
6,135,928 A * 10/2000 Butterfield ..... 482/69
6,139,475 A 10/2000 Bessler et al.
6,302,828 B1 10/2001 Martin et al.
6,578,594 B1 6/2003 Dowen et al.

* cited by examiner

*Primary Examiner*—Fenn C. Mathew

(57) ABSTRACT

An ambulatory patient support mechanism, for use in hospitals and the like for assisting patients in walking along hallways, corridors, and the like. The mechanism includes a specially developed U-shaped support frame, configured to support a person in an upright position while walking. A telescoping column is vertically adjustable relative to the floor. A moveable carriage connected to the telescoping column provides horizontal movement along a suspended overhead track vertically above a given path of a hallway, corridor, or the like. A rotation mechanism allows the U-shaped frame to rotate 180° allowing patients to reverse their direction of travel along the given path. The U-shaped frame is adjustable to accommodate a wide range of body sizes. A pair of adjustable handgrips at the end of each U-frame member stabilizes the patient within the interior of the U-shaped frame. Commonly used belting and buckles secure each of the patient's upper arms to an arm restraint to aid in fall prevention should patient stumble or lose consciousness. When not in use, the mechanism can be folded to lie flat against the ceiling for storage.

11 Claims, 7 Drawing Sheets

AMBULATORY PATIENT SUPPORT MECHANISM

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

Field of Invention

The present invention relates to an ambulatory support mechanism particularly suited for supporting and stabilizing an ambulatory patient who needs to walk for exercise without the fear of falling.

BACKGROUND OF THE INVENTION

Hospitals encourage patients to walk as soon and as frequently as possible following surgery or an illness. Walking helps neutralize anesthesia and prevents blood clots from forming. A disease of circulation known as DVT, deep vein thrombosis, is a blood clot in a vein located deep in the muscles of the legs, thighs, pelvis or arms. DVT occurs most often in people who have not been able to exercise normally. The condition can become dangerous, or even fatal, if the blood clot becomes dislodged. Walking can help prevent blood clots by increasing circulation throughout the body, but specifically to the heart. Walking helps to build endurance, relieve stress, and allow the patient to regain their strength more quickly. This exercise often allows patients to leave the hospital sooner or aids in their rehabilitation process.

Most walking exercise within a hospital occurs when a nurse or physical therapist walks a patient in the hallway or corridor. There are several devices currently used to keep the patient upright while walking. These devices include crutches, canes, walkers, gait belts, parallel bars and other walking aids.

The most widely used device in hospitals for helping patients walk is a gait belt or gait harness. An example of this type of apparatus is exemplified in U.S. Pat. No. 5,397,171 of Leach (1995) for a gait assistance harness apparatus. There are many variations on this device including thick fabric, leather or nylon. The belt or harness is secured around the patient's waist and/or chest. At the side or rear of the belt or harness are handholds for the nurse to use. The nurse walks behind or at the side of the patient, grasping the attached handhold to steady the patient. It is commonly known that when a patient falls while using the gait belt or harness apparatus, the caregiver often falls with them. It is difficult for the caregiver to totally support the patient who stumbles or loses consciousness. Severe injury can occur to the nurse and/or the patient in this situation. For this reason alone, many patients elect not to walk as part of their recovery therapy. In other instances, assistance from others is not readily available and the patient is unavoidably confined, to their detriment.

Another type of walking aid is exemplified in U.S. Pat. No. 6,578,594 of Bowen et al (2003) for a Mobile Rehabilitative Walker. This device is typically not suitable for general use within a hospital. This walker as well as other supportive walking aids, such as U.S. Pat. No. 5,569,129 of Seif-Naraghi et al (1996) disclosing a Device for Patient Gait Training, requires that a patient strap themselves into a harness. This harness is similar to those used by mountain climbers and requires the patient to fully dress before using the device. It is unreasonable to ask a hospitalized patient to fully dress and don a harness before they can walk down the corridor. In many respects, Bowen's walker and other similar devices compromise patient dignity. It is embarrassing to be seen in such severe paraphernalia. Supportive walkers using body harnesses present problems for patients recovering from certain chest and shoulder surgeries. The required harness straps may apply unwanted pressure to the operative areas. Bowen's walker also requires a large base frame for stability and to prevent tipping. The size of the frame makes it impractical to use in most hospital corridors. It is also very difficult to store when not in use. A device of this size cannot be left in a hallway when not in use. It is commonly stored in an equipment closet or other such location, and can be time consuming for a nurse to locate and retrieve this device when needed for patient use.

U.S. Pat. No. 3,985,082 of Barac (1976) discloses an electrified ambulatory walker whereby the overhead track incorporates a motorized carriage. Motors housed in a telescoping arm serve to drive the carriage along the track. It is said to aid the patient in walking along the direction of the track. There are significant drawbacks of using such an electrified carriage system. The initial cost of wiring can be prohibitive. The ongoing maintenance of an electrified system of this type is typically much more expensive than a purely mechanical device.

U.S. Pat. No. 6,168,548 of Fleming (2001) discloses a portable ambulatory therapy device using parallel bars to help ambulatory patients develop or regain walking skills. Parallel bar devices such Fleming's as well as canes and rolling walkers suffer a common deficiency. They require the patient to have adequate arm and upper body strength to support themselves. They do not provide for patient safety if the patient losses consciousness while ambulating.

Therefore, it would be advantageous to develop a support mechanism that ambulatory patients would feel comfortable and safe using without compromising their dignity. It would also be advantageous to develop such a mechanism that does not require a full body harness for patient support. It would also be advantageous to develop such a mechanism that caregivers such as nurses and physical therapists would find easy to adjust for patients of differing sizes. It would also be advantageous that a mechanism be easily stored when not in use but readily available. It would also be advantageous to develop such a mechanism that did not require electrification for its operation.

BACKGROUND OF THE INVENTION

Objects and Advantages

It is therefore an object of the present invention to provide a mechanism for supporting an ambulatory patient for certain walking exercises, and provide the following objects and advantages:

a) to provide a mechanism for securing a person in the upright orientation while ambulating;

b) to provide a mechanism for facilitating exercise and rehabilitation procedures;

c) to provide a mechanism that keeps a person secured within the device if they lose consciousness;

d) to provide a mechanism that allows a patient to traverse along a given path and reverse direction of travel while still being secured;

e) to provide a mechanism that can be used without a body harness;

f) to provide a mechanism that can be adjusted for patients of differing sizes;

g) to provide a mechanism that requires minimal adjustments by the caregiver for its use;

h) to provide a mechanism whose use can be taught without extensive caregiver training;

i) to provide a mechanism whose size is such that it will not interfere with other equipment found in a hospital corridor, such as beds, gurneys, wheelchairs, IV trolleys and the like;

j) to provide a mechanism whose small size will allow it to be located close to patient areas making it readily available when needed;

k) to provide a mechanism that can be easily used in a corridor or hallway, but is otherwise stored out of the way when not in use;

l) to provide a mechanism that does not require electrification for its operation.

Additional objects and advantages of the invention will be set forth in the description which follows, and in part will be apparent from the description, or may be learned by the practice of the invention without undue experimentation. The objects and advantages of the invention may be realized and obtained by means of the instruments and combinations particularly pointed out in the appended claims.

SUMMARY

In accordance with the present invention an ambulatory patient support mechanism comprises an overhead track with a horizontal moving carriage, a telescoping column attached to the carriage at its upper end and terminating at a U-shaped support frame at its lower end. Each member of the U-shaped support frame terminates in a patient handhold with which a patient can support themselves inside the U-shaped frame while walking along the path of the overhead track.

DRAWINGS—FIGURES

In the drawings, closely related figures have the same number but different alphabetic suffixes.

DRAWINGS - Reference Numerals

| | | | |
|---|---|---|---|
| 8 | frame structure | 9 | protective bumper |
| 10 | air cylinder | 10A | cylinder housing |
| 10B | cylinder sliding rod | 11 | IV hook |
| 12 | telescoping column | 12A | upper column member |
| 12B | lower column member | 13 | rotation stop |
| 18 | hollow elongated rail | 19 | end cap |
| 20 | pivoting mechanism | 21 | patient back support |
| 22 | underarm support assembly | 22A | arm support rail |
| 22B | slidable arm restraint | 22C | pivoting arm |
| 22D | handgrip | 22E | belting and buckle |
| 24 | arm restraint | 25 | U-shaped support frame |
| 27 | overhead track | 29 | ambulating patient |
| 30A | pinning mechanism | 30B | pinning mechanism |
| 30C | pinning mechanism | 30D | pinning mechanism |
| 30E | pinning mechanism | 31 | hospital corridor |
| 33 | rolling carriage structure | 35 | walk path |
| 37 | floor | 39 | rotating mechanism |
| 39A | lower end | 39B | upper end |
| 50 | trolley & rotating mechanism attachment point | 51 | rotating mechanism & frame attachment point |
| 52 | telescoping column & frame attachment point | 53 | rotation stop & frame attachment point |
| 54 | frame and air cylinder attachment point | 55 | pivot arm and arm support rail attachment point |
| 56 | telescoping column & air cylinder attachment point | | |

DETAILED DESCRIPTION

FIGS. 1-6—Preferred Embodiment

Figure 1:
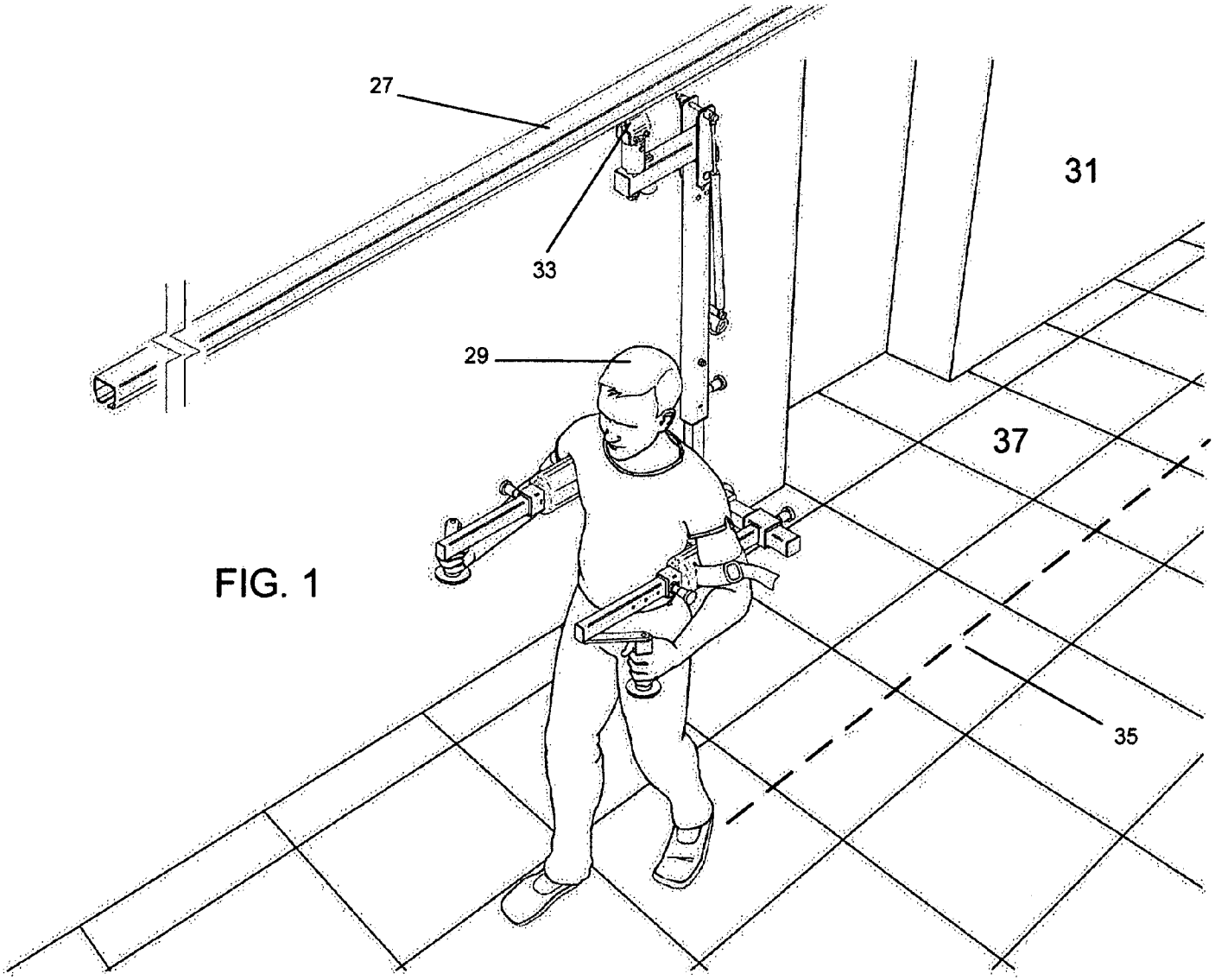
FIG. 1 is a perspective view of a preferred embodiment of the ambulatory patient support mechanism of the present invention being used by a person.

Referring first to FIG. 1, there is shown a portion of a hospital corridor 31 wherein a given walk path is represented by the dashed line 35 on the floor 37 of the corridor 31. An overhead track 27 in turn is secured to a ceiling of the corridor 31 in a position vertically above and providing for the walk path 35 for an ambulating patient 29. A rolling carriage structure 33 is coupled to the overhead track 27 for movement along the track 27.

Figure 2:
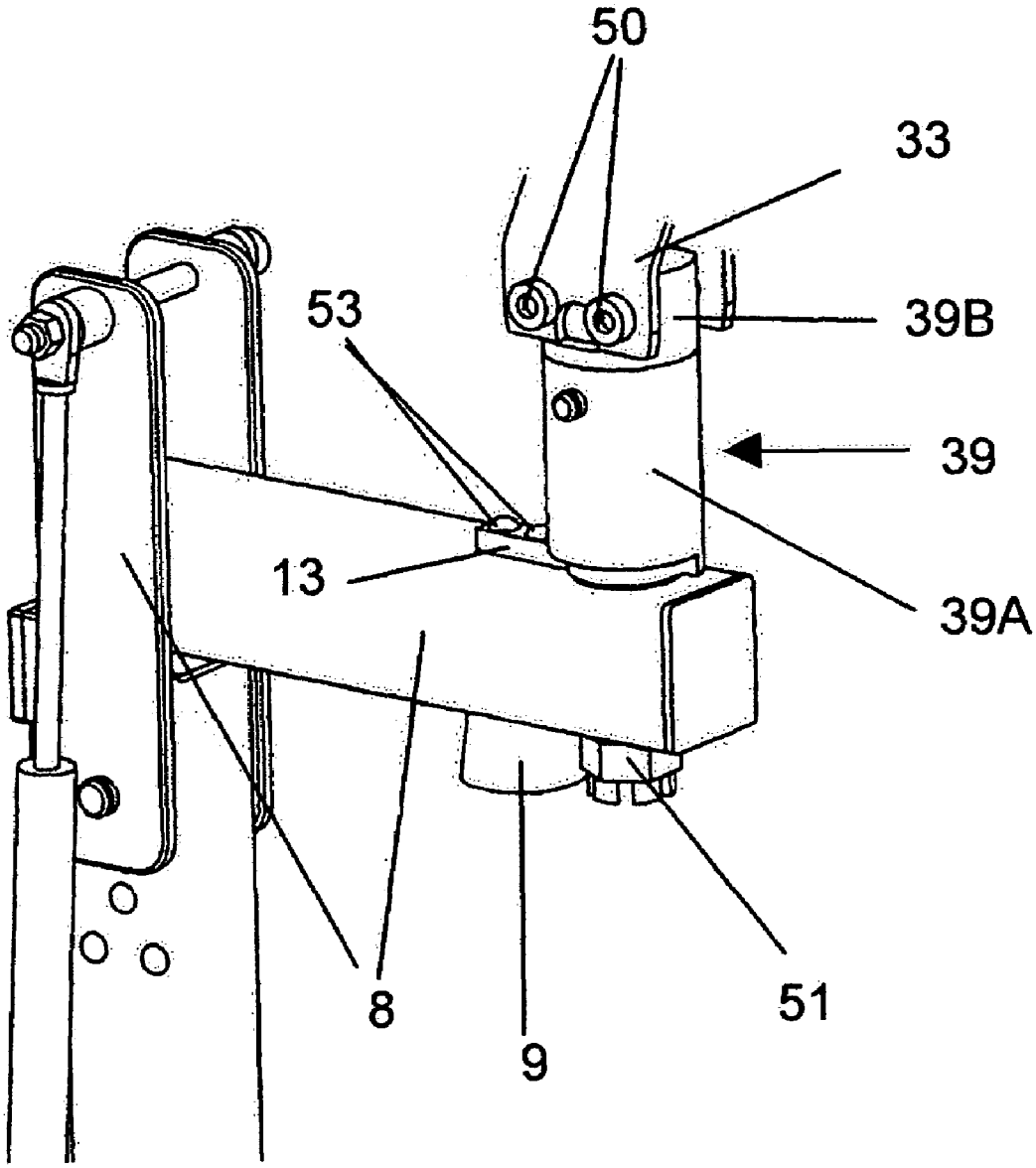
FIG. 2 is a partial perspective view of a preferred embodiment of the frame structure and rotating mechanism.

As shown in FIG. 2, a conventional rotating mechanism 39 has its upper end 39B secured to the carriage 33 as at 50 and its lower end 39A secured to a frame structure 8, as at 51. The lower end 39A is rotatable relative to the upper end 39B about a vertical axis through the center of the rotating mechanism 39. A rotation stop 13 is secured to the frame 8 as at 53. The stop 13 prevents rotation of more than 180° of the lower end of the rotating mechanism 39A relative to the carriage 33. A protective bumper 9 is secured to the frame structure 8 and is used when folding the device for storage.

Figure 3:
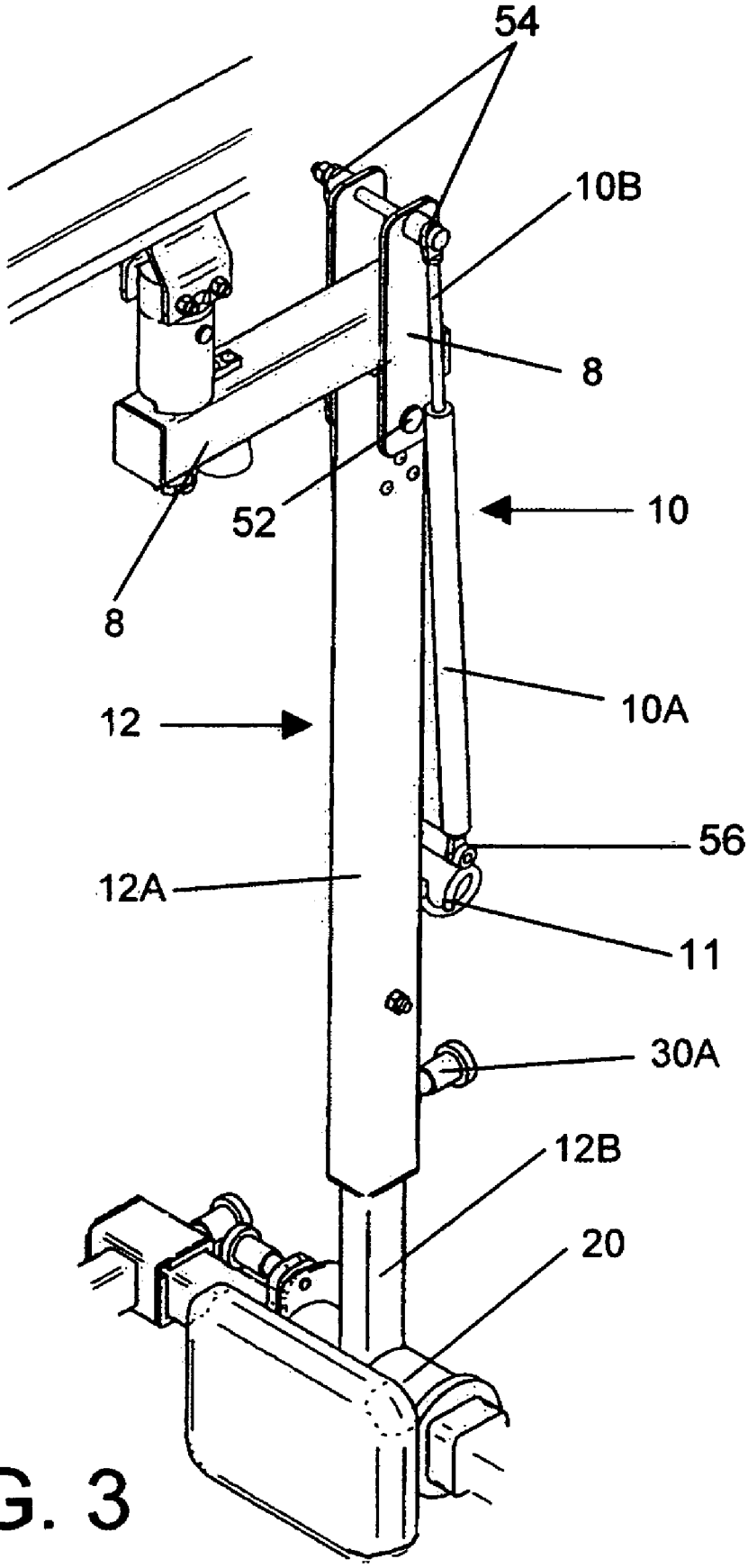
FIG. 3 is a partial perspective view of a preferred embodiment of the telescoping column, air cylinder, frame structure, and rotating mechanism.

Referring now to FIG. 3, a telescoping column 12 in turn has its upper end secured to the frame structure 8 as at 52. The column 12 extends vertically downward to terminate at a weldment on a pivoting mechanism 20. A pinning mechanism 30A on the telescoping column 12 secures together an upper column member 12A to a lower column member 12B when meshed into one of the plurality of holes on the lower column 12B. An air cylinder 10 has its housing 10A secured to the column 12 as at 56. An air cylinder sliding rod 10B is secured to the frame structure 8 as at 54. The air cylinder 10 provides lifting motion of the column 12 when folding the device for storage. An IV hook 11 is secured to the upper column 12A by weldment at contiguous locations of the IV hook 11 and the column 12A.

Figure 4:
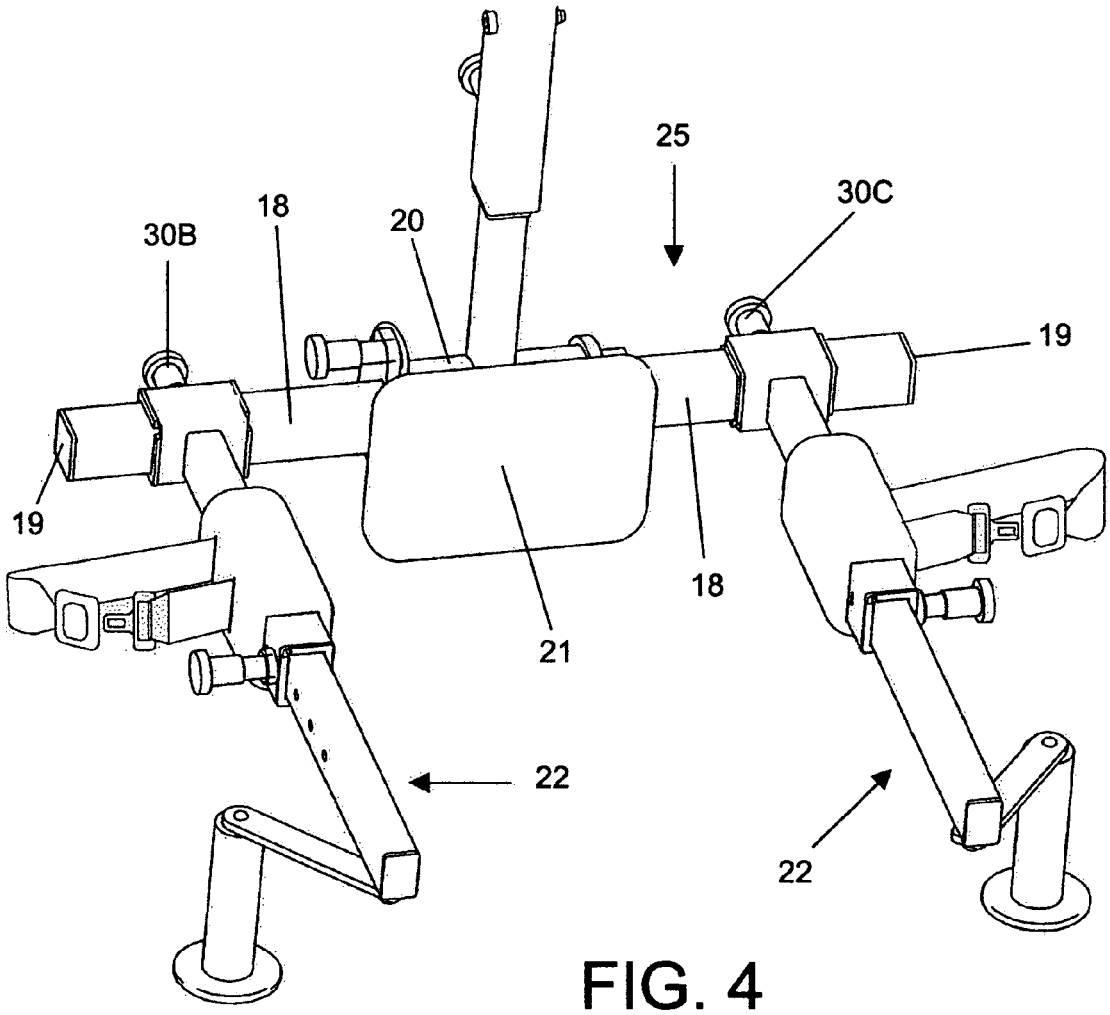
FIG. 4 is a partial perspective view of a preferred embodiment of the U-shaped frame assembly.

There is shown in FIG. 4 a U-shaped support frame 25. The support frame 25 comprises a hollow elongated rail 18, the pivoting mechanism 20, a patient back support 21, and a pair of underarm support assemblies 22 at opposing ends of the elongated rail 18. An end cap 19 is secured to opposing ends of the elongated rail 18. A pinning mechanism 30B and a pinning mechanism 30C located at rearward ends of the underarm support assemblies 22 secure the underarm assemblies 22 to the elongated rail 18 when meshed into one of the plurality of holes in the elongated rail 18.

Figure 5:
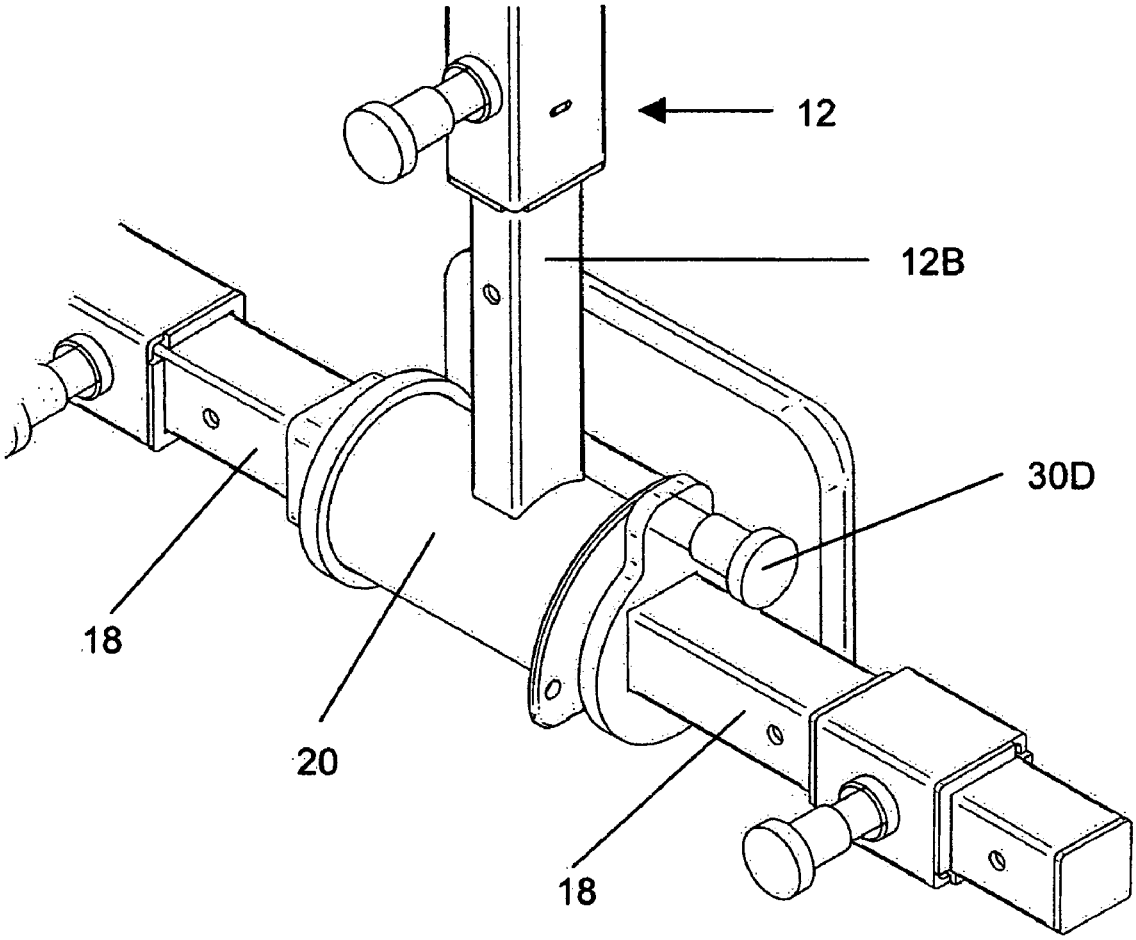
FIG. 5 is a partial perspective view of a preferred embodiment of the hollow elongated rail and pivoting mechanism.

Referring now to FIG. 5, the pivoting mechanism 20 is secured, to the lower column member 12*b*. The hollow elongated rail 18 passes through an opening in the pivoting mechanism 20. Equal lengths of the elongated rail 18 protrude on each side of the pivoting mechanism 20 with weldments at contiguous locations of the pivoting mechanism 20 and the elongated rail 18. By this arrangement, the elongated rail 18 is affixed to the telescoping column 12, but is allowed to rotate a maximum of 90° in a counter clockwise direction relative to the column 12. A pinning mechanism 30D prevents the elongated rail 18 from rotation when meshed into one of the plurality of holes in the pivoting mechanism 20.

Figure 6:
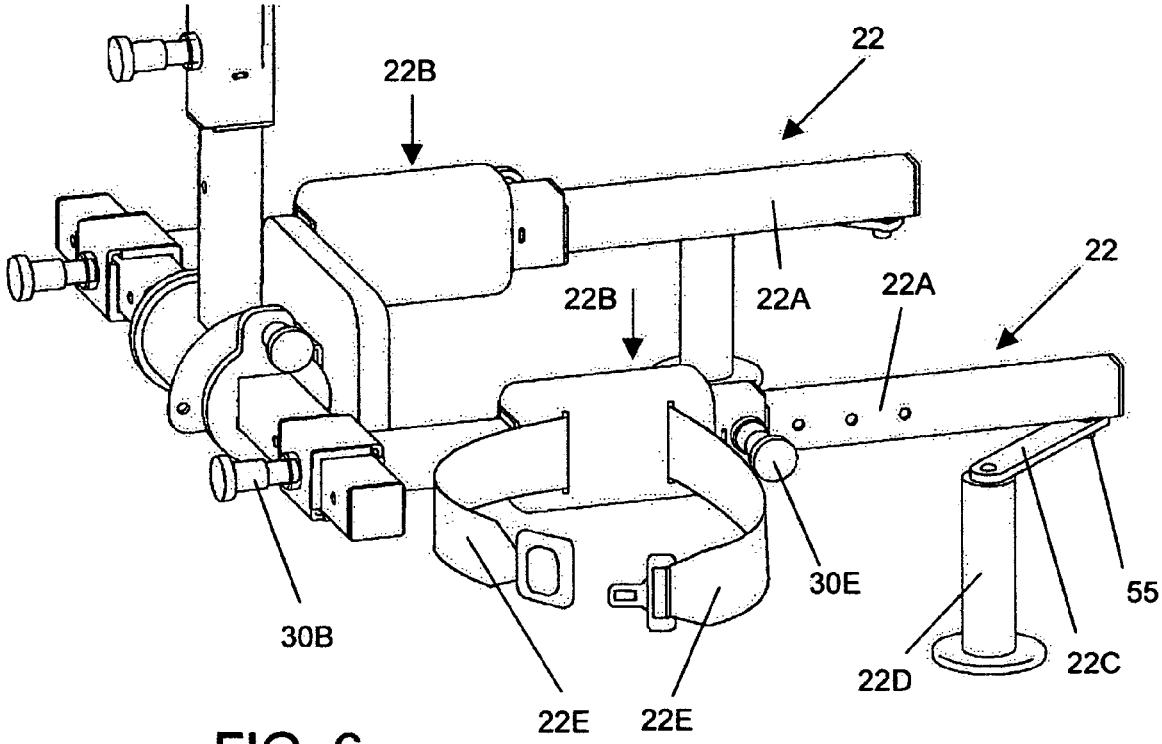
FIG. 6 is a partial perspective view of a preferred embodiment of the underarm support assemblies.

There is shown in FIG. 6, the pair of underarm support assemblies 22. Each of the two assemblies 22 comprises an arm support rail 22A, a pinning mechanism 30B, a slidable arm restraint 22B, a commonly known method of belting and buckle 22E, a pinning mechanism 30E, a pivoting arm 22C, and a handgrip 22D. The support rail 22A and the slidable arm restraint 22B are of rectangular cross section so that they are keyed against rotation relative to each other. The handgrip 22D can be adjusted to accommodate patients of differing sizes when rotated either clockwise or counter clockwise about a vertical axis through the center of the attachment point of the pivoting arm 22C and the arm support rail 22A, as at 55. The slidable restraint 22B moves along the arm rail 22A and is secured to the arm rail 22A when pinning mechanism 30E is meshed into one of the plurality of holes located in the arm support rail 22A. The slidable restraint 22B is padded with conventional materials, such as high-density foam, to protect the underside of the patient's arm when secured to the restraint 22B. In FIG. 1, there is shown the slidable restraint 22B positioned under the patient's armpits. The handgrip 22D has been adjusted to a convenient position to support and aid the patient 29 in walking along the path 4. The belting and buckles 22E secure the patient's arm to the arm restraint 22B and thusly to the underarm support assembly 22.

Operation—FIGS. 1-7

In operation, an attendant makes adjustments to the device to accommodate the patient's height and width, readying the device for patient usage. The ambulating patient 29 stands inside the U-shaped support frame 25 with their back placed against the back support 21. The attendant adjusts the height of the U-shaped frame 25 relative to the floor at a level in accord with the patient's height. The adjustment ensures the underarm support assemblies 22 fit comfortably beneath the patient's armpits. This adjustment is effected by operating the pinning mechanism 30A, and telescopically raising or lowering the lower column member 12B until desired height is obtained. Releasing the pinning mechanism 30A into one of the plurality of holes in the lower column 12B secures the column member 12B to the upper column member 12A.

The attendant then adjusts the width of the U-shaped frame 25 by positioning the underarm support assemblies 22 at a comfortable distance from the patient's body. The underarm support assemblies 22 are moved laterally across the elongated rail 18 to be a comfortable distance from the patient's body. This adjustment is effected by operating the pinning mechanisms 30B and 30C, moving the left and/or the right underarm support assembly 22 toward or away from the patient's body until the desired position is achieved. Releasing the pinning mechanisms 30B and 30C into one of the plurality of holes in the elongated rail 18 secures the assemblies 22 to the elongated rail 18.

The attendant would then position the slidable arm restraint 22B under the patient's armpits and secure the patient's upper arm with the belting 22E. This adjustment is effected by operating pinning mechanism 30E, moving the slidable restraint 22B along arm support rail 22A and releasing pinning mechanism 30E into one of the plurality of holes in the arm rail 22A. By this arrangement, the patient's arms are prevented from lifting up should the patient 29 stumble or lose consciousness. This preventative action keeps the patient secured inside the U-shaped frame 25.

The patient 29 clasps the handgrip 22D and rotates the handgrip 22D until a comfortable position for ambulating is achieved. This adjustment is effected by rotating the handgrip 22D in a clockwise or counter clockwise direction relative to a vertical axis through the center of the attachment point of the pivoting arm 22C and the arm rail 22A, as at 55.

The carriage 33, the frame structure 8, the telescoping column 12, and the U-shaped support frame 25 all move as a unit along the track 27. If desired, the patient 29 can reverse direction of their travel by turning the U-shaped frame 25 in a 180° direction while still secured within its interior. The telescoping column 12 and thusly, the U-shaped frame 25 rotate relative to the floor 37 at the rotating mechanism 6, as at 51.

It is desired, however, that the present invention be easily stored when not in use but that it maintain its availability at the point of need. This is accomplished by leaving the mechanism on the overhead track 27, folding the mechanism in a plurality of distinct movements and laying it flat against the ceiling of the hospital corridor or the like. In this position it is out of the way for anyone wanting to traverse the corridor.

Figure 7:
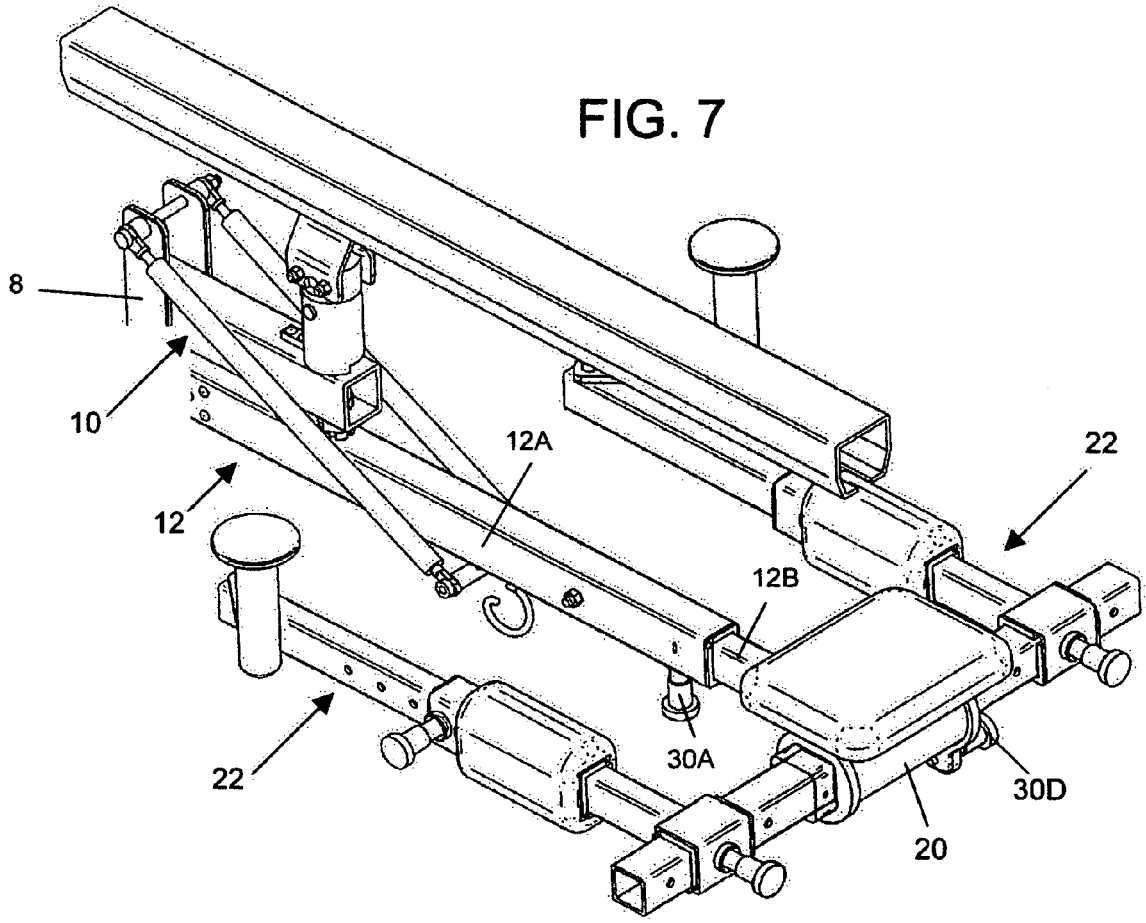
FIG. 7 is a perspective view of the ambulatory patient support mechanism of FIG. 1 shown in a folded for storage position.

FIG. 7 shows the mechanism in a storage position. Folding of the device is accomplished by an attendant in multiple steps. Referring now to FIG. 2 and FIG. 7, the attendant operates the pinning mechanism 30D, pivots the arm support assemblies 22 upwardly (in a counter clockwise direction relative to the telescoping column 12) and releases the pinning mechanism 30D into one of the plurality of holes in the pivoting mechanism 20. The attendant then operates the pinning mechanism 30A, and telescopically slides the lower column 12B into the upper column 12A the maximum telescopic travel allowed. Pinning mechanism 30A is then released into one of the plurality of holes in the telescopic column 12. Now, grasping the column 12 and pivoting it toward the ceiling (in a counter clockwise direction relative to a vertical axis through the center of the column 12), the air cylinder 10 pulls the assembly upward. The column 12 is then positioned against the protective bumper 9 of the frame structure 8. The attendant may unfold the device by reversing the aforementioned folding procedures.

CONCLUSION, RAMIFICATIONS, AND SCOPE

From the foregoing description of the ambulatory patient support mechanism, it will be evident to the reader that the present invention has provided an important and needed therapeutic device to the end that patients will be aided and supported when walking within the confines of a hospital corridor or the like following surgery or an illness that has left them in a weakened condition, but still ambulatory.

Accordingly, the device is easily stored, eliminating the need for separate equipment rooms. It can be stored at the point of use, making it available when needed, thus eliminating time consuming search and location of equipment.

We claim:

1. An ambulatory patient support mechanism adapted to be connected to an overhead track that is secured to a ceiling vertically above and parallel with a given walk path, comprising:

a rolling carriage structure engaging and movable along said overhead track;

a frame structure having opposed end portions;

a rotating mechanism having an upper end secured to the carriage and a lower end secured to one of the opposed end portions of said frame structure;

a telescoping column oriented in a substantially vertical direction and having a lower end portion and an upper end portion and the upper end portion of the telescoping column being attached to the other opposed end portion of the frame structure; and a U-shaped support frame extends in a substantially horizontal direction from the telescoping column and being attached to the lower end portion of said telescoping column.

2. The ambulatory patient support mechanism of claim 1 wherein the lower end of the rotating mechanism is rotatable relative to the upper end thereof about a vertical axis defined through the center of the rotating mechanism and the opposed end portions of the frame structure are oriented in a substantially horizontal direction and one of the opposed end portions rotates about the vertical axis of the rotating mechanism.

3. The ambulatory patient support mechanism of claim 2 wherein said telescoping column includes:

an upper column member secured at its top end to the other one of the opposed end portions of the frame structure; and a lower column member telescopically received in the bottom end of the first member and extending vertically downward to terminate at its bottom end at the U-shaped support frame.

4. The ambulatory patient support mechanism of claim 1, wherein said U-shaped support frame includes:

a hollow elongated rail;

a pivoting mechanism attaching said telescoping column to the elongated rail;

a pair of underarm support assemblies slideable on the elongated rail; and a patient back support affixed to the front side of the pivoting mechanism.

5. The ambulatory patient support mechanism of claim 4, wherein said hollow elongated rail includes equal lengths of the elongated rail on each side of said pivoting mechanism with weldments at contiguous locations of said pivoting mechanism and the elongated rail.

6. The ambulatory patient support mechanism of claim 4, wherein the pair of underarm support assemblies includes:

an arm support rail;

a first pinning mechanism for securing the arm support rail to the elongated rail;

a padded slidable arm restraint for positioning and securing patient's upper arm;

a belting and buckle device for securing patients arm to the arm restraint;

a second pinning mechanism for securing the arm restraint to the arm rail;

a handgrip means for stabilizing the patient when walking; and a pivoting arm means for rotation and positioning of the handgrip.

7. The ambulatory patient support mechanism of claim 1 wherein said frame structure includes:

an air cylinder having a cylinder housing secured to the telescoping column and a cylinder sliding rod secured to the frame structure adapted to provide means for lifting the column during storage;

a protective bumper secured to the frame structure; and a rotation stop mounted on the frame structure and operative to limit the degree of rotation of the rotating mechanism.

8. The ambulatory patient support mechanism of claim 1 wherein the telescoping column is selectively pivotably connected to the frame structure.

9. The ambulatory patient support mechanism of claim 1 wherein the U-shaped support frame is selectively pivotably connected to the telescoping column.

10. A method for storing an ambulatory patient support mechanism that includes a rolling carriage structure adapted to engage and move along an overhead track secured to a ceiling above and parallel with a given walk path; a rotating mechanism having a vertical axis and being secured to the carriage and to a frame structure; a telescoping column having a first pinning mechanism for adjusting the telescoping thereof and being pivotably connected at one end to the frame structure and secured from pivoting therewith by a second pinning mechanism; and a U-shaped support frame perpendicularly connected to the other end of the telescoping column by a pivoting mechanism and secured from pivoting with the telescoping column by a third pinning mechanism; and an underarm support assembly secured to the U-shaped support frame, comprising the steps of:

operating said third pinning mechanism on said pivoting mechanism;

pivoting said underarm support assembly upwardly, in a direction at which the U-shaped member is parallel with said telescoping column;

releasing said third pinning mechanism into one of the plurality of holes on said pivoting mechanism;

operating said first pinning mechanism on said telescoping column;

sliding said lower column member into said upper column member the maximum distance of telescopic travel allowed;

releasing said first pinning mechanism into one of the plurality of holes in said telescoping column;

grasping said telescoping column and pivoting it toward the ceiling in a direction towards the vertical axis defined through the center of said rotating mechanism; and stopping rotational movement when said telescoping column rests against the protective bumper on said frame structure.

11. A method of unfolding the ambulatory patient support mechanism of claim 10 for patient usage, comprising the steps of:

reversing steps used in claim 8 for folding the ambulatory patient support mechanism.

* * * * *